US009194670B2

(12) United States Patent
Gendregske

(10) Patent No.: US 9,194,670 B2
(45) Date of Patent: Nov. 24, 2015

(54) APPARATUS FOR MAXIMIZING DAMAGE CAUSED BY A PROJECTILE TO A HUNTED ANIMAL

(71) Applicant: Stephen Gendregske, Ypsilanti, MI (US)

(72) Inventor: Stephen Gendregske, Ypsilanti, MI (US)

( * ) Notice: Subject to any disclaimer, the term of this patent is extended or adjusted under 35 U.S.C. 154(b) by 0 days.

(21) Appl. No.: 14/213,021

(22) Filed: Mar. 14, 2014

(65) Prior Publication Data

US 2014/0187363 A1 Jul. 3, 2014

Related U.S. Application Data

(63) Continuation-in-part of application No. 13/602,143, filed on Sep. 1, 2012, now Pat. No. 8,784,242.

(60) Provisional application No. 61/576,912, filed on Dec. 16, 2011, provisional application No. 61/785,386, filed on Mar. 14, 2013.

(51) Int. Cl.
*F42B 6/04* (2006.01)
*F42B 12/36* (2006.01)

(52) U.S. Cl.
CPC ..... *F42B 6/04* (2013.01); *F42B 12/362* (2013.01)

(58) Field of Classification Search
CPC ..... F42B 6/02; F42B 6/04; F42B 12/362
See application file for complete search history.

(56) References Cited

U.S. PATENT DOCUMENTS

| | | | | |
|---|---|---|---|---|
| 3,759,519 | A * | 9/1973 | Palma | 473/578 |
| 3,993,311 | A | 11/1976 | Johnson | |
| 4,182,327 | A * | 1/1980 | Haley | 604/130 |
| 4,252,325 | A | 2/1981 | Weems et al. | |
| 6,238,310 | B1 | 5/2001 | Morrison | |
| 6,719,652 | B1 | 4/2004 | Rhodes, Jr. | |
| 8,079,926 | B2 | 12/2011 | Mackey, Jr. et al. | |
| 2007/0225093 | A1 | 9/2007 | Kidwell | |
| 2008/0146388 | A1 | 6/2008 | Palomaki et al. | |
| 2008/0248904 | A1 | 10/2008 | Cyr et al. | |

* cited by examiner

*Primary Examiner* — John Ricci
(74) *Attorney, Agent, or Firm* — Vincent Re PLLC

(57) ABSTRACT

An apparatus disclosed to maximize damage from a projectile to a hunted animal. The apparatus, a hunting projectile, includes an outer shaft assembly comprising an outer shaft, fletches, and a plurality of retention fins extending outwardly radially from the outer shaft. The apparatus further includes an inner shaft assembly fitting slidably inside the outer shaft and comprising an inner shaft and a piercing tip.

7 Claims, 9 Drawing Sheets

APPARATUS FOR MAXIMIZING DAMAGE CAUSED BY A PROJECTILE TO A HUNTED ANIMAL

CROSS REFERENCE TO RELATED APPLICATIONS

This disclosure claims the benefit of U.S. Provisional Application No. 61/785,386 filed on Mar. 14, 2013 and is a continuation-in-part of U.S. application Ser. No. 13/602,143 filed on Sep. 1, 2012 which claims the benefit of U.S. Provisional Application No. 61/576,912 filed on Dec. 16, 2011 which are hereby incorporated by reference.

TECHNICAL FIELD

This disclosure is related to a hunting using a bow or a crossbow.

BACKGROUND

The statements in this section merely provide background information related to the present disclosure. Accordingly, such statements are not intended to constitute an admission of prior art.

Crossbows and bows can be used to launch a hunting projectile at a game animal for the purpose of taking the animal. A crossbow launches a bolt, and a bow launches an arrow. A hunting projectile includes a sharp or piercing tip. According to one embodiment, the tip includes a broad-head tip known in the art. A tip can be connected to an insert, for example, made of a plastic material, and the insert can be fastened or adhered within a front end of the shaft. A hunting projectile includes fletching. Fletching traditionally included feathers helping the projectile to fly true. Modern fletching can include plastic devices formed into shapes similar to feather fletching. The projectile includes a shaft connecting to the tip and the fletching. According to one known configuration, fletching is connected to a rear portion of the shaft, with three fletches dispersed equally around the shaft and aligned longitudinally with the shaft. An arrow can include a nock connected to the rear end of an arrow, including a notch to fit upon a bow string.

Modern hunting equipment includes powerful launching equipment and effective projectiles. The projectile can be fired effectively to long ranges and with high projectile speeds. However, upon hitting an animal being hunted, the high speed of the projectile and an effective broad-head tip design can result in the projectile passing entirely through the hunted animal. Even if the projectile successfully pierces a vital organ of the hunted animal and results in an ultimately lethal injury to the animal, the wound without any remnant of the projectile remaining in the wound can result in only minor bleeding. The wounded animal can run a great distance from the hunter before succumbing to the wound, and with only minimal bleeding, the hunter may not be able to see enough blood to track the animal. Further, the process is less humane to the hunted animal if the animal survives for a long time with a fatal wound than if the animal is brought down quickly.

SUMMARY

An apparatus disclosed to maximize damage from a projectile to a hunted animal. The apparatus, a hunting projectile, includes an outer shaft assembly comprising an outer shaft, fletches, and a plurality of retention fins extending outwardly radially from the outer shaft. The apparatus further includes an inner shaft assembly fitting slidably inside the outer shaft and comprising an inner shaft and a piercing tip.

BRIEF DESCRIPTION OF THE DRAWINGS

One or more embodiments will now be described, by way of example, with reference to the accompanying drawings, in which:

FIG. 4A illustrates a grappling structure configured to inner shaft including two grappling arms;

FIG. 4B illustrates a grappling structure configured to inner shaft including three grappling arms; and FIG. 4C illustrates a grappling structure configured to inner shaft including four grappling arms;

FIG. 5A illustrates exemplary grappling arms starting from a perpendicular direction from shaft and curving forward at the ends of the arms;

FIG. 5B illustrates exemplary grappling arms extending in a perpendicular direction from shaft; and FIG. 5C illustrates exemplary grappling arms bend starting from in a swept back orientation from shaft and curving forward at the ends of the arms;

FIG. 12A illustrates a side view of tip adaptor; and

FIG. 12B illustrates an end view of the tip adaptor;

FIG. 16A illustrates the bloodletting assembly in detail; and

FIG. 16B illustrates the rectangular rod in cross-section including cut-outs;

DETAILED DESCRIPTION

Figure 1:
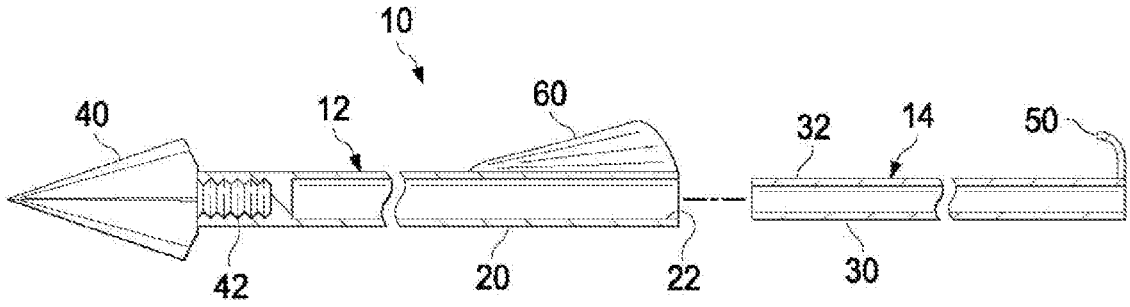
FIG. 1 illustrates in cross section a projectile including an outer shaft and an inner shaft, in accordance with the present disclosure.

Referring now to the drawings, wherein the showings are for the purpose of illustrating certain exemplary embodiments only and not for the purpose of limiting the same, a projectile for hunting a game animal is disclosed. The projectile includes two portions. A first portion is configured for aerodynamic characteristics known in the art for a crossbow bolt or an arrow. A second portion is configured to reside within a wound of a game animal, keeping the wound as open as possible and providing a channel for blood to escape the animal. Prior to being fired at the game animal, the first and second portions of the projectile are assembled, with the first portion being substantially an outer surface of the projectile and the second portion being substantially carried within the first portion. The outer surface of the first portion includes a bolt or arrow shaft, preferably a smooth, unbroken outer surface with no holes for optimal aerodynamic flight. The second portion fits within the first portion such that the second portion can slide out of the first portion with little force. A pointed tip, such as an arrowhead, is situated at the front of the first portion, and the tip and the shaft of the first portion are configured to pierce flesh of game animal and pass easily through the flesh. Fletches, frequently constructed of thin, flexible plastic, stabilize flight of the projectile. Fletches can exist upon either the first portion or the second portion. In one embodiment, fletches upon the first portion are flexible and deflect easily to pass through the flesh of the game animal easily with the first portion. The second portion includes a grappling structure at a rearward end of the second portion configured to catch upon the flesh as the rearward end of the projectile penetrates the flesh. The grappling structure comprises a prong or prongs that extend outwardly from the grappling structure. The grappling structure comprises at least one prong extending perpendicularly to the axial direction of the wound resident member. The prongs can be described as grappling arms. The grappling structure hitting upon the flesh provides force upon the second portion sufficient to separate the first portion and the second portion. The momentum of the first portion carries the first portion through the flesh and out of the game animal, while the second portion remains within the animal as a member resident within the wound.

The first portion can be described as an outer shaft assembly. The shaft of the outer shaft assembly must be hollow and include a rear aperture in order to receive the second portion. The second portion can be described as a bloodletting assembly. In addition to the grappling structure, the second portion includes an elongated wound resident member configured to fit within the hollow shaft of the outer shaft assembly. The elongated wound resident member extends within the hollow cylindrical shaft in an axial direction of the wound resident member. The elongated wound resident member can include a number of different cross sectional shapes. The wound resident member can be a hollow round shaft or a solid round shaft. The wound resident member can be a creased or crimped tube, with at least one crease running longitudinally down the wound resident member. The wound resident member can be a rod with a square, rectangular, triangular, or other shaped cross section.

The wound resident member preferably includes a bloodletting feature facilitating blood flow from the wound. A crease running longitudinally down the wound resident member permits blood to flow along the crease without being blocked by flesh. Alternatively, a groove or slot can be cut partially or entirely through a solid rod longitudinally along the wound resident member to similarly permit blood flow along the groove. Alternatively, a wound resident member embodied as a hollow shaft can include holes permitting blood to flow through the holes and into the hollow center of the shaft. The hollow shaft is preferably open on either end of the shaft permitting blood to flow through the shaft and out of one of the open ends.

FIG. 1 illustrates in cross section a projectile including an outer shaft and an inner shaft. Projectile 10 is illustrated, including a first portion of the projectile embodied as outer shaft assembly 12 and a second portion of the projectile or bloodletting assembly embodied as inner shaft assembly 14. Outer shaft assembly 12 includes tip 40, outer shaft 20, and fletch 60. In the cross section of FIG. 1, only a single fletch 60 is illustrated. One having skill in the art will appreciate that it is common to have a plurality of fletches spaced at even radial locations around a shaft, for example, with three fletches located at 120 degree intervals around the shaft. Tip 40 is illustrated as a broad-head tip known in the art, but any known hunting tip can be used according to the methods disclosed, and the disclosure is not intended to be limited to the particular exemplary embodiments provided herein. Tip 40 is fastened to outer shaft 20. In the embodiment of FIG. 1, tip 40 includes threaded portion 42 screwed into a mating inner diameter of outer shaft 20, but a number of embodiments of methods to fasten tip 40 to outer shaft 20 can be utilized, and the disclosure is not intended to be limited to the particular exemplary embodiments provided herein.

Inner shaft assembly 14 includes inner shaft 30 and grappling structure 50. Inner shaft 30 includes outer wall surface 32 configured and sized to insert within an inner wall surface 22 of outer shaft 20. Inner shaft 30 can slide within outer shaft 20, such that grappling structure 50 is proximate to a rear end of fletch 60. In one embodiment, inner shaft assembly 14 can be substantially the length of the outer shaft 20 minus a length of threaded portion 42, such that the inner shaft assembly spans an entire cavity within outer shaft assembly 22. In another embodiment, inner shaft assembly 14 can be some portion of the length of outer shaft assembly 22. In one embodiment, inner shaft 30 can have a substantially same outer diameter as an inner diameter of outer shaft 20, such that the two shafts have a sliding contact. In another embodiment, inner shaft 20 and outer shaft 30 can have a slight interference fit, for example, to ensure that the two shafts do not move relative to each other in flight. In such an embodiment, the interference between the shafts must be small enough that the inner shaft can still slide out of outer shaft with a minimal force. In one embodiment, a lubricant can be used between the shafts. In another embodiment, the outer diameter of inner shaft 30 can be smaller than the inner diameter of outer shaft 20.

Normally a projectile can fly through a hunted animal, leaving only a narrow puncture wound which tends to close back up. Tip 40 is designed to pierce the flesh of the animal and pass through it as efficiently as possible. The narrow round shaft provides little resistance to passing through the flesh. Fletches 60 are usually thin and aligned substantially with the shaft or slightly twisted around the shaft just enough to spin the projectile in flight. Such thin fletches are usually flexible and can easily pass through the flesh of the animal with the arrow. An apparatus is provided wherein projectile 10 with outer shaft assembly 12 can strike an animal with inner shaft assembly 14 slidably inserted within outer shaft assembly 12. The outer shaft assembly 12 can pass directly through the animal. Inner shaft assembly 14 is provided with grappling structure 50 configured not to pass easily through flesh, such that inner shaft assembly will not pass through the animal and remain inside the wound, stopping the wound from closing. In one embodiment, inner shaft assembly 14 can include a bloodletting detail, such that the inner shaft assembly 14 provides a path for blood pass along the shaft or within the shaft and bleed outside of the animal, hastening rapid blood loss of the animal.

Grappling structure 50 includes fixed or movable features that are wider than the shaft of the outer shaft assembly 12 in order to catch upon the flesh of the animal. A single grappling arm can be used, but it will be appreciated that the projectile is preferably substantially symmetrical around the projectile, such that the flight characteristics of the projectile are not adversely impacted by an unbalanced projectile.

Figure 2:
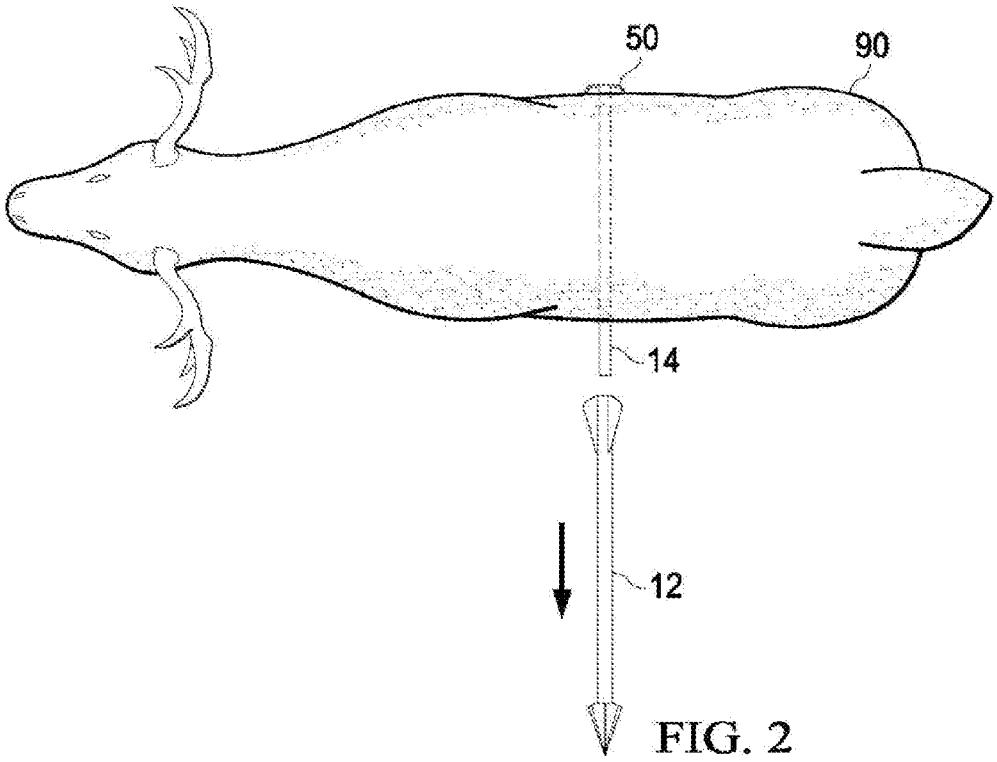
FIG. 2 illustrates an animal, an outer shaft assembly passing through the animal, and an inner shaft assembly remaining within the animal, in accordance with the present disclosure.

FIG. 2 illustrates a game animal, an exemplary outer shaft assembly passing through the animal, and an exemplary inner shaft assembly remaining within the animal. Animal 90 is illustrated. A projectile including outer shaft assembly 12 with inner shaft assembly 14 inserted within outer shaft assembly 12 has been shot at the animal. Outer shaft assembly is illustrated having passed through the animal and flying on past the animal. Inner shaft assembly including grappling structure 50 is shown impaled in the animal, with the inner shaft assembly having traveled with the outer shaft assembly until the grappling assembly caught upon the entrance side of the animal. At that time, the outer shaft assembly continues on, while the inner shaft assembly stops forward motion and remains in the animal, held in place by the grappling structure 50.

Figure 3:
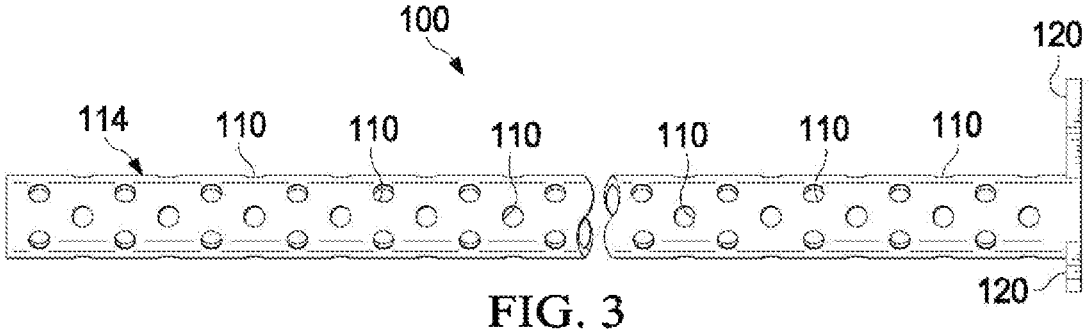
FIG. 3 illustrates an inner shaft assembly including a plurality of holes exemplifying a bloodletting detail, in accordance with the present disclosure.

FIG. 3 illustrates an inner shaft assembly including a plurality of holes exemplifying a bloodletting detail. Inner shaft assembly 100 is illustrated including shaft 114 and holes 110. Holes 110 permit blood within the animal to pass from outside of shaft 114 to inside of the shaft. One or both ends of shaft 114 are open, such that blood inside the shaft can flow out of one or both ends of the shaft.

Figure 4A:
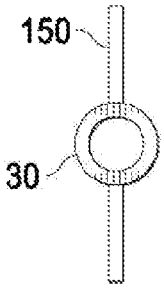
FIGS. 4A, 4B, and 4C illustrate different configurations of a grappling structure, in accordance with the present disclosure.
Figure 4B:
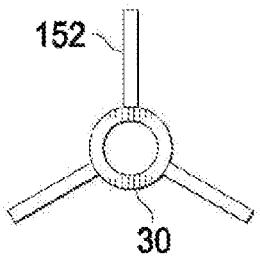
Figure 4C:
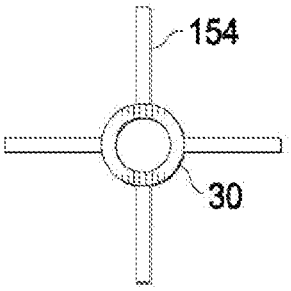

FIGS. 4A, 4B, and 4C illustrate different configurations of a grappling structure. FIG. 4A illustrates a grappling structure 150 configured to inner shaft 30 including two grappling arms. FIG. 4B illustrates a grappling structure 152 configured to inner shaft 30 including three grappling arms. FIG. 4C illustrates a grappling structure 154 configured to inner shaft 30 including four grappling arms. Each of the illustrated configurations show shaft 30 with an outer diameter and inner diameter. The grappling structures are fastened to the shaft by welding, adhesive, through a screw on interface, or any other method known in the art. Preferably, the attachment of the grappling structures to the shaft block the hole created by the inner diameter of the shaft as little as possible, permitting a maximum blood flow from the shaft. A number of grappling structure configurations are envisioned, and the disclosure is not intended to be limited to the particular exemplary embodiments provided herein.

Figure 5A:
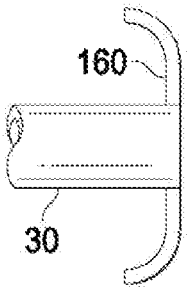
FIGS. 5A, 5B, and 5C illustrate different shapes that grappling arms of a grappling structure can take, in accordance with the present disclosure.
Figure 5B:
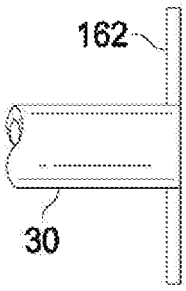
Figure 5C:
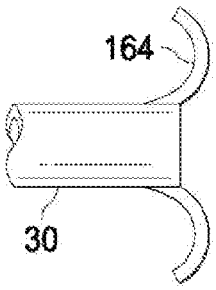

FIGS. 5A, 5B, and 5C illustrate different shapes that grappling arms of a grappling structure can take. FIG. 5A illustrates exemplary grappling arms 160 starting from a perpendicular direction from shaft 30 and curving forward at the ends of the arms. FIG. 5B illustrates exemplary grappling arms 162 extending in a perpendicular direction from shaft 30. FIG. 5C illustrates exemplary grappling arms 164 bend starting from in a swept back orientation from shaft 30 and curving forward at the ends of the arms. A number of grappling structure configurations are envisioned, and the disclosure is not intended to be limited to the particular exemplary embodiments provided herein.

Figure 6:
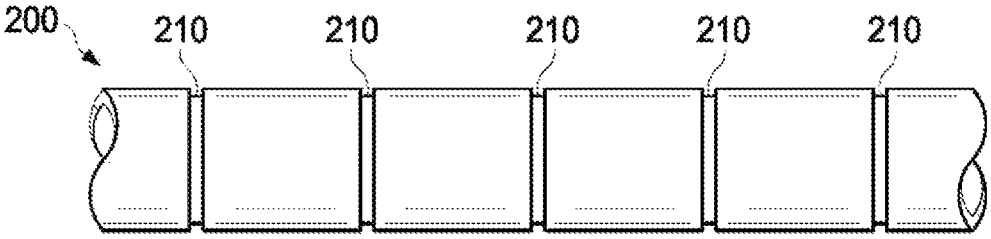
FIG. 6 illustrates an exemplary inner shaft including a series of etchings or grooves in the shaft, in accordance with the present disclosure.
Figure 7:
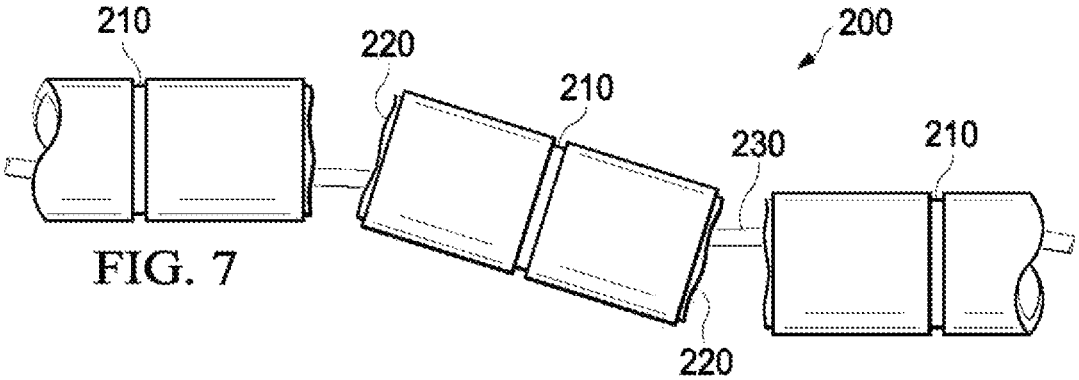
FIG. 7 illustrates an exemplary inner shaft with a series of grooves and a cable running through the center of the shaft, in accordance with the present disclosure.

Inner shaft assembly 14 remains in the animal to facilitate rapid blood loss to quickly bring the animal down. However, the animal can still survive for a time. Within a running animal fleeing the hunter, the inner shaft assembly can experience significant stresses. Bones and muscles can bend the shaft and kink the inner diameter, such that blood flow through the shaft is restricted. FIG. 6 illustrates an inner shaft including a series of annular etchings or grooves in the shaft. Shaft 200 includes grooves 210 cut some depth into the surface of shaft 200. When shaft 200 is exposed to stress, the shaft tends to break at one of grooves 210 instead of bending. The two resulting sections of shaft 200 maintain their original round shapes and can continue to permit blood to flow within the shaft sections despite the break. FIG. 7 illustrates an inner shaft with a series of grooves and a cable running through the center of the shaft. Shaft 200 is illustrated with a plurality of grooves 210. Two of grooves 210 have broken resulting in broken edges 220. Cable 230 acts as a shaft aligning device, holding the portions of the shaft in sufficient alignment to facilitate blood flow, and is illustrated running within shaft 200 in order to retain the sections of shaft 200 after the breaks. Cable 230 is connected to different locations within shaft 200 in order to retain an ability to keep all sections of the broken shaft together and proximate to each other. In this way, the sections remain proximate to each other and substantially act as an intact conduit for blood to pass through despite the breaks.

Figure 8:
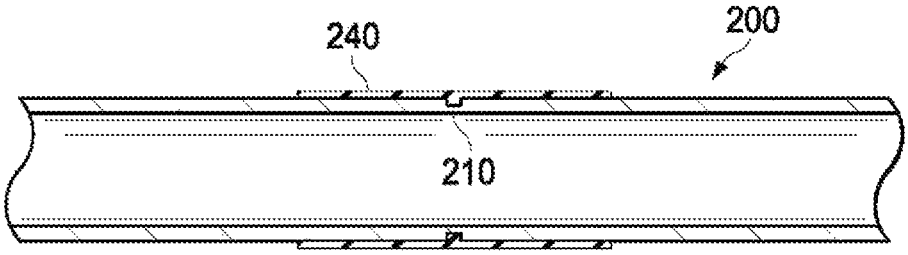
FIG. 8 illustrates an exemplary shaft including a groove and a polymer material covering the groove, in accordance with the present disclosure.

FIG. 8 illustrates a shaft including a groove and a polymer material covering the groove. Shaft 200 is illustrated with a groove 210 configured to break instead of permitting the shaft to bend and kink. Polymer material 240 acts as a shaft aligning device, holding the portions of the shaft in sufficient alignment to facilitate blood flow, and is illustrated covering groove 240. Polymer material 240 is shaped into a polymer sleeve and can include any rubberized material or flexible plastic material. One example of polymer material 240 can be situated to groove 210 with a shrink wrap process known in the art. When shaft 200 breaks at groove 210, polymer material 240 can flex and permit the sections of 200 to shift while the elastic properties of the polymer material permit the sections to remain joined. In the embodiment of FIG. 8, shaft 200 needs to be smaller than a mating outer shaft such that the polymer material can fit within the outer shaft without hanging up the sliding contact between the shafts.

Figure 9:
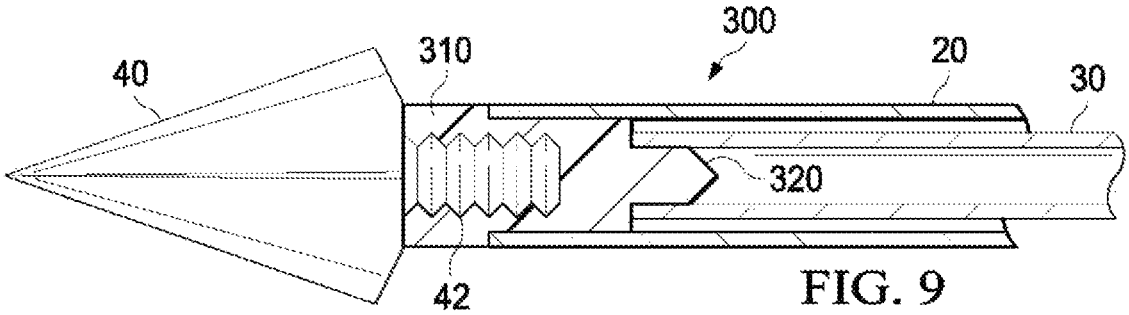
FIG. 9 illustrates a feature within an exemplary outer shaft to seat the inner shaft, in accordance with the present disclosure.

Projectiles require excellent balance to fly straight and true to a target. FIG. 9 illustrates a feature within an exemplary outer shaft to seat the inner shaft. Configuration 300 includes tip 40, outer shaft 20, inner shaft 30, and tip adaptor 310. Exemplary tip adaptor 310 includes a feature to accept tip 40, for example, a threaded hole accepting threaded portion 42. Tip adaptor 310 is fitted within outer shaft 20, for example, glued within the inner diameter of the outer shaft. Additionally, tip adaptor 310 includes inner shaft seating feature 320. Exemplary seating feature 320 includes a pointed stud that fits within the inner diameter of inner shaft 30. By locating or seating the end of inner shaft 30, the inner shaft and outer shaft can remain in a fixed and mutually centered configuration in flight, causing the projectile to be more stable than a projectile where the inner shaft is biased in one direction.

Figure 10:
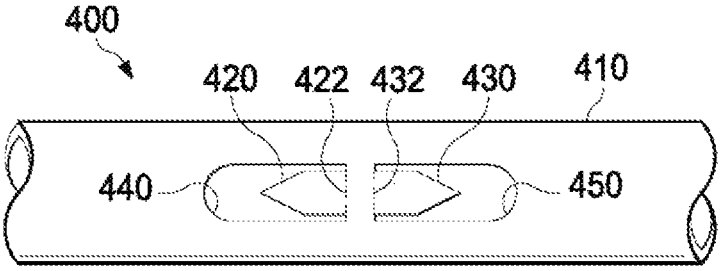
FIG. 10 illustrates a shaft with an exemplary retention feature, in accordance with the present disclosure.

A wounded animal with an object impaled within it can use its mouth to attempt to pull out the object. If the animal pulls on the object correctly, it can pull out the object, causing the wound to close back up. FIG. 10 illustrates a shaft with an exemplary retention feature. Configuration 400 includes shaft 410, retention barbs 420 and 430, and holes 440 and 450. When impaled within the animal, barbs 420 and 430 can snag the flesh within the animal. Dotted lines 422 and 432 show where barbs 420 and 430 respectively can be bent upward after snagging on flesh to make the shaft even more difficult to pull out. Additionally, the snags can cause greater tissue damage facilitating additional bleeding.

Figure 11:
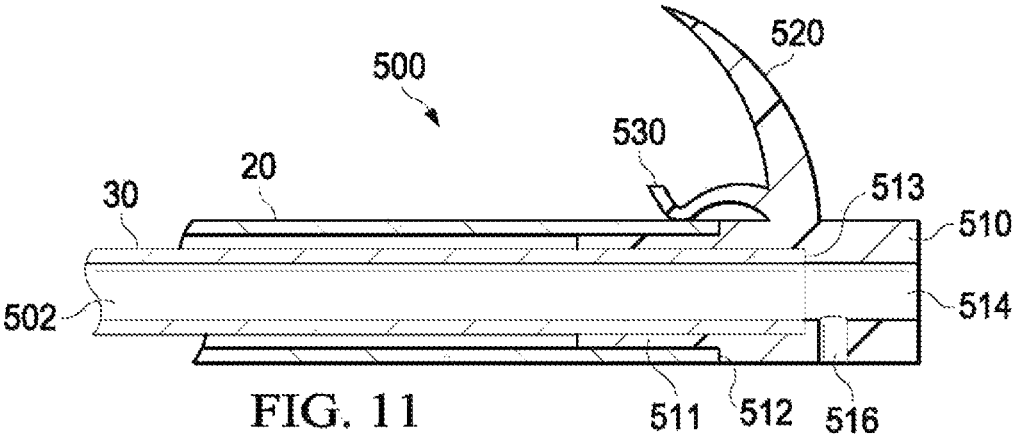
FIG. 11 illustrates in cross-section an exemplary polymer grappling section affixed to a rear end of a bloodletting assembly, the polymer grappling section including an outer shaft retention barb, in accordance with the present disclosure.

FIG. 11 illustrates in cross-section an exemplary polymer grappling section affixed to a rear end of a bloodletting assembly, the polymer grappling section including an outer shaft retention barb. Configuration 500 includes an outer shaft 20 and bloodletting assembly 502 including an inner shaft 30 and a polymer grappling section 510. Polymer grappling section 510 includes grappling arm 520, cavity 513 for receiving inner shaft 30, bloodletting apertures 514 and 516, and outer shaft retention barb 530. Polymer grappling section 510 can be adhered to inner shaft 30, the polymer grappling section 510 can be molded over the inner shaft 30, or the polymer grappling section 510 can be attached to the inner shaft according any method known in the art. Bloodletting apertures 514 and 516 are provided to increase blood flow from the bloodletting assembly 502 and prevent a single clogged aperture from ceasing blood flow from the wound. Neck section 511 of polymer grappling section 510 fits within outer shaft 20 and helps to locate the polymer grappling section 510 to the outer shaft 20. Outer shaft retention barb 530 grips the outer shaft 20 and prevents the outer shaft 20 from unintentionally disengaging from the polymer grappling section 510. However, the outer shaft retention barb 530 includes only a loose grip on the outer shaft 20, such that the force of the entire projectile hitting the game animal and the inertia of the outer shaft assembly still separate the polymer grappling section 510 from the outer shaft 20.

Figure 12A:
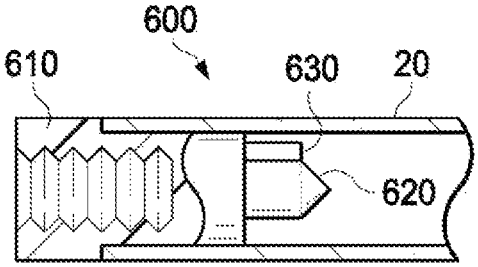
FIGS. 12A and 12B illustrate an exemplary tip adaptor including a rotation tab locating an inner shaft rotation to an indexed rotation with relation to an outer shaft assembly, in accordance with the present disclosure.
Figure 12B:
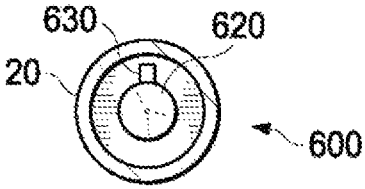

FIGS. 12A and 12B illustrate an exemplary tip adaptor including a rotation tab locating an inner shaft rotation to an indexed rotation with relation to an outer shaft assembly. FIG. 12A illustrates a side view of tip adaptor and FIG. 12B illustrates an end view of the tip adaptor. Configuration 600 includes tip adaptor 610 and outer shaft 20. For an exemplary projectile with three fletches and three grappling arms, it can be advantageous for the fletches and the grappling arms to be rotationally aligned, wherein the inner shaft is turned to an indexed rotation to align the fletches and grappling arms. A projectile can include a rotation indexing feature to align the bloodletting assembly to a certain rotation with respect to the outer shaft assembly. Tip adaptor 610 includes inner shaft seating feature 620 including tab 630. An end of a mating inner shaft can include a notch, such that the inner shaft can only be fully seated against the inner shaft seating feature 620 if the notch in the inner shaft is aligned to tab 630. In another example, a tab and notch configuration could be configured to the polymer grappling section of FIG. 11 to rotationally align the polymer grappling section to the outer shaft. Other methods to rotationally align an inner shaft to an outer shaft are envisioned, and the disclosure is not intended to be limited to the particular exemplary embodiments provided herein.

Inner shafts can be made of aluminum or other similar materials of which the outer shaft is commonly constructed. In another embodiment, the inner shaft can be a plastic or other polymer material. According to one embodiment, a white Derlin (R) acetal resin or wear resistant nylon 6/6 tube. In another embodiment, a carbon laminate can be used to construct the inner shaft. A number of different inner shaft materials are envisioned, and the disclosure is not intended to be limited to the particular exemplary materials or constructions provided herein.

Figure 13:
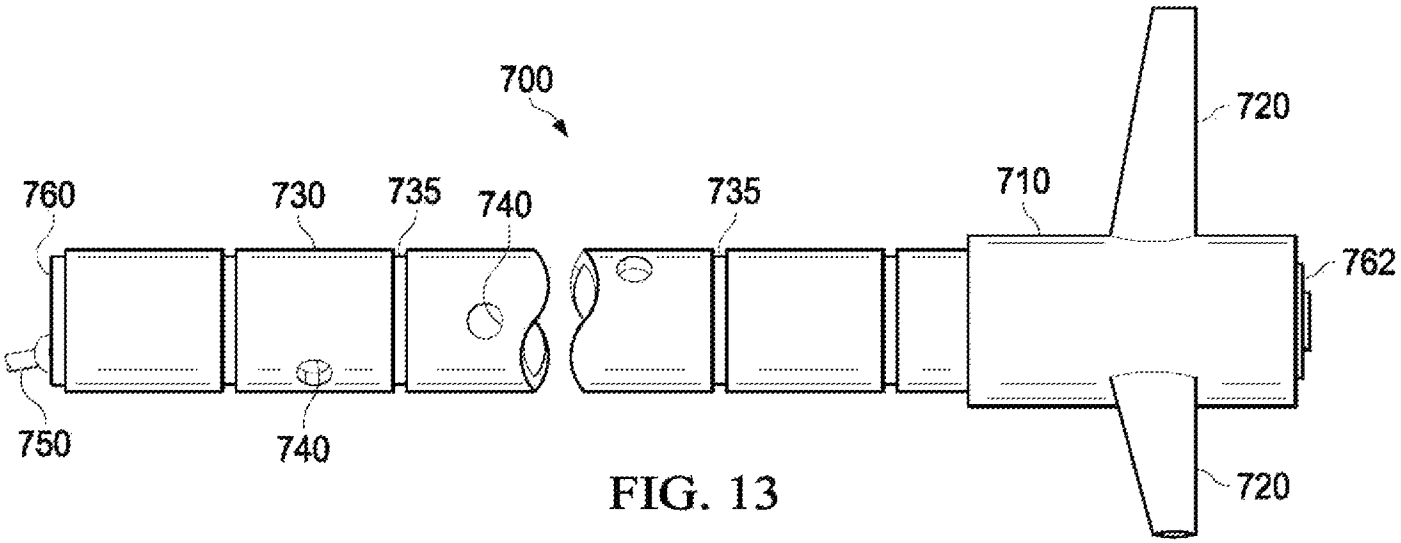
FIG. 13 illustrates an exemplary bloodletting assembly molded as a one-piece design, in accordance with the present disclosure.

FIG. 13 illustrates an exemplary bloodletting assembly molded as a one-piece design. Configuration 700 is constructed as a one piece design bloodletting assembly and includes an elongated wound resident member including inner shaft 730 configured to be inserted within an outer shaft assembly, rear grappling section 710, and grappling arms 720. Inner shaft 730 includes a number of exemplary holes 740 permitting blood to flow from outside of the inner shaft 730 to a hollow section inside of inner shaft 730. Both ends of configuration 700 can be open to the hollow section to permit blood flow from both ends of the wound resident member. According to one exemplary embodiment to manufacture a one piece design, the one piece design can be injection molded with materials known in the art, with one half of the mold being in a direction behind the illustrated configuration 700 and the other half of the mold being in the direction of the viewer. Core pins with hydraulic activation can be used to create the hollow section inside the shaft and the holes going into the shaft. A hydraulically actuated section of the mold would be required to make portions of the grappling arms 720 not in die draw of either mold half according to methods known in the art. Optional grooves 735 are illustrated formed into inner shaft 730 to permit the inner shaft 730 to break within the game animal and prevent the inner shaft from crimping. Further, an optional wire can be used down the middle of the hollow shaft section to retain pieces of the shaft in close proximity to each other if the shaft is broken. A washer and rivet 762 is illustrated to hold one end of the wire, and a washer 760 and knot 750 are illustrated to hold the other end of the wire. Any methods can be used to hold the wire inside of the hollow section, and the disclosure is not intended to be limited to the exemplary embodiments provided herein. Holes permitting blood flow from either end of configuration can be formed in rear grappling section 710 and/or the front end of inner shaft 730.

Figure 14:
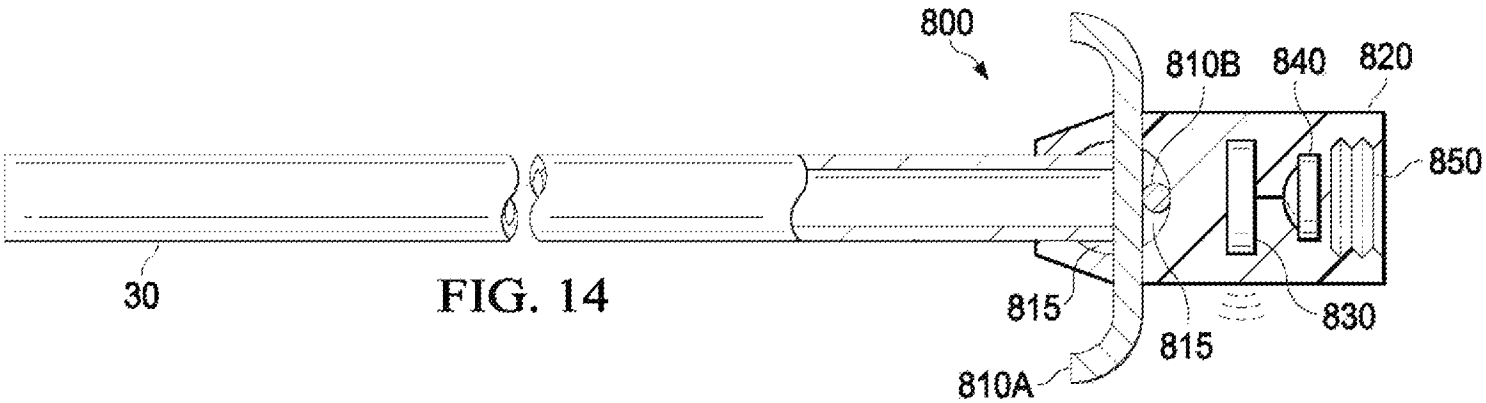
FIG. 14 illustrates an exemplary bloodletting assembly including a radio transmitter device useful to permit a hunter to track a game animal with the inner shaft assembly secured thereto, in accordance with the present disclosure.

FIG. 14 illustrates an exemplary bloodletting assembly including a radio transmitter device useful to permit a hunter to track a game animal with the inner shaft assembly secured thereto. Game animals can run great distances after being hit by a projectile. Configuration 800 includes a radio transmitter device 830 permitting a hunter to use a corresponding receiver device known in the art to determine a direction to the radio transmitter device 830. Configuration 800 further includes an elongated wound resident member including inner shaft 30, housing 820, grappling arms 810A and 810B, battery 840 and exemplary screw-on battery cover 850. Weld material 815 is illustrated, wherein grappling arms 810A and 810B are composed of metal wires and inner shaft 30 is composed of metal, and weld material 815 connects the grappling arms and the inner shaft. Housing 820 is molded, fitted, or otherwise formed or connected around the welded parts and includes cavities for accepting radio transmitted device 830, battery 840, and battery cover 850. Radio transmitter device 830 includes a circuit board constructed according to methods known in the art and includes an antennae structure for transmitting a signal that can be tracked by the hunter.

Figure 15:
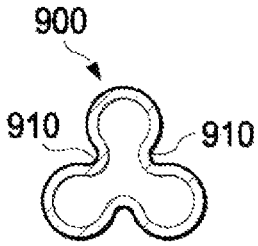
FIG. 15 illustrates an exemplary crimped or creased tube that can be used as part of a wound resident member, in accordance with the present disclosure.

A bloodletting assembly can include a wound resident member and a grappling structure, wherein the wound resident member includes an exemplary inner shaft with a round cross-section. In other embodiments, the wound resident member can include a shaft or rod with a different cross-section. FIG. 15 illustrates an exemplary crimped or creased tube that can be used as part of a wound resident member. Configuration 900 includes a tube with a plurality of creases 910 that run axially down a shaft, such that the creases act as a bloodletting feature. The tube can include holes to additionally permit blood to flow within the tube according to methods disclosed herein. Any number of creases can be included on the shaft.

Figure 16A:
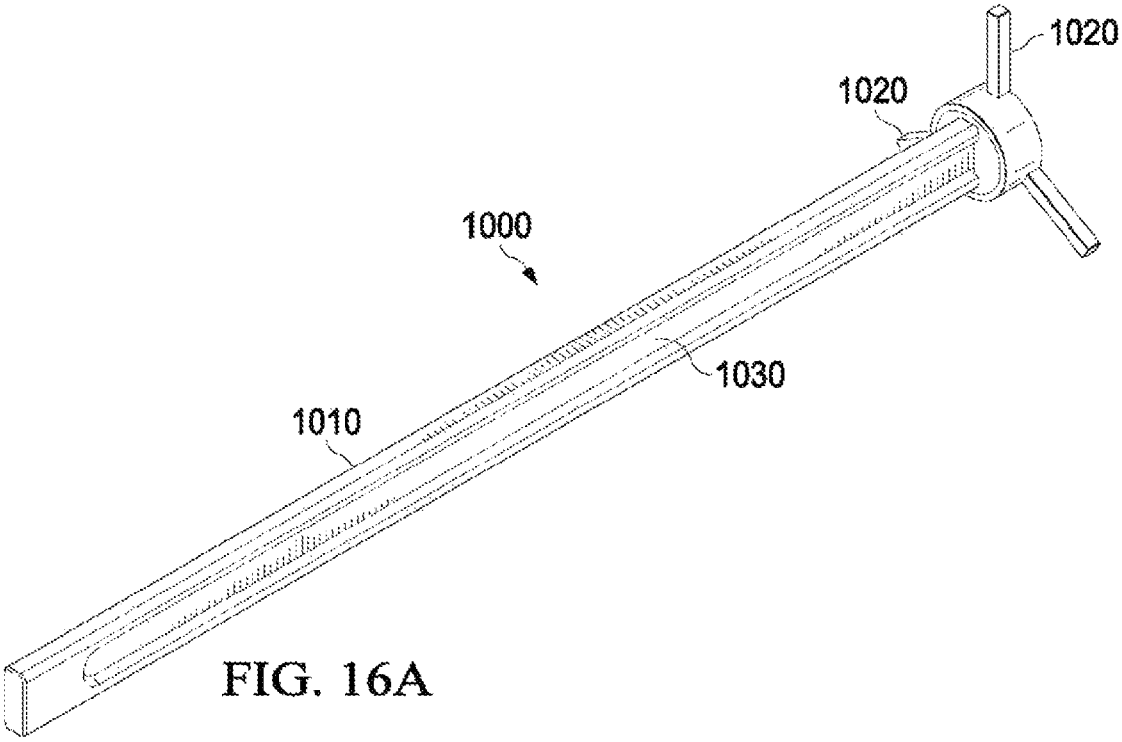
FIGS. 16A and 16B illustrate an exemplary bloodletting assembly including a rod with a rectangular cross-section including cut-out sections along a length of the rod, the cut-out sections acting as a bloodletting feature, in accordance with the present disclosure.
Figure 16B:
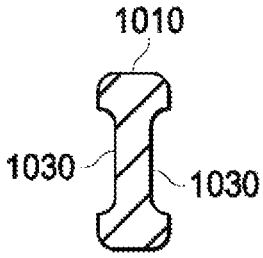

FIGS. 16A and 16B illustrate an exemplary bloodletting assembly including a rod with a rectangular cross-section including cut-out sections along a length of the rod, the cut-out sections acting as a bloodletting feature. FIG. 16A illustrates the bloodletting assembly in detail. Configuration 1000 includes an elongated wound resident member including rod 1010 and grappling arms 1020. Rod 1010 includes a rectangular cross section. Cut-outs 1030 are formed along the length of rod 1010 and each create within a wound a channel through which blood can flow. FIG. 16B illustrates the rectangular rod 1010 in cross-section including cut-outs 1030.

An arrow used with a bow includes a nock at the rear of the arrow including a slot to nest the bow string to the arrow. A nock can be used with a hole drilled or formed down a longitudinal axis of the nock to permit blood flow therethrough. Some nock designs do not permit a hole or a large hole at the rear of the arrow. In one embodiment, a detachable nock can be used to nest the arrow to the bow string, and, subsequent to the release of the arrow, detach from the rear of the arrow, leaving the shaft of the arrow hollow in the rear to facilitate bleeding in accordance with methods disclosed herein.

Crossbows can have different designs that may interact with the grappling structure. A grappling structure with a certain number of grappling arms may be selected based upon the bolt being able to be situated upon the crossbow correctly and firing from the crossbow correctly.

An arrow or bolt with an inner and outer shaft can weigh more than a projectile with a single shaft. Weight can impact the flight characteristics of the projectile. Wall thicknesses of the wound resident member and outer shaft can be modulated to achieve a desired resulting weight of the projectile. Different materials such as light weight polymers can be used, for example, in construction of the outer shaft and the grappling structure to reduce an overall weight of the projectile.

An inner shaft or other wound resident member could be treated or coated with an anti-coagulant chemical or coating to prevent blood from clotting in the shaft.

Hunting tips come in various sizes. A broad-head hunting tip with a reduced cross-section or reduced width can be used with the projectiles herein to increase a likelihood that the outer shaft assembly will pass through the hunted animal.

Different crossbow designs can be used with the projectiles disclosed herein. One particular crossbow utilizing a reverse draw wherein the flexing arms of the crossbow are parallel to the direction of the firing of the projectile is known. Such a crossbow and other crossbow or bow designs can utilize the projectiles disclosed herein.

An inner shaft assembly as disclosed in FIGS. 1-16B can extend through a substantial portion of the outer shaft assembly. A longer inner shaft assembly, remaining within the wound of the animal, penetrates more flesh and keeps a larger portion of the flesh of the animal from resealing after the outer shaft assembly passes through. In one embodiment, the inner shaft assembly can extend at least half the length of the outer shaft assembly. In another embodiment, the inner shaft assembly can span the entire cavity within the outer shaft assembly, for example, coming into contact with the fitting inserted within the front of the outer shaft assembly to hold the piercing tip.

Figure 17:
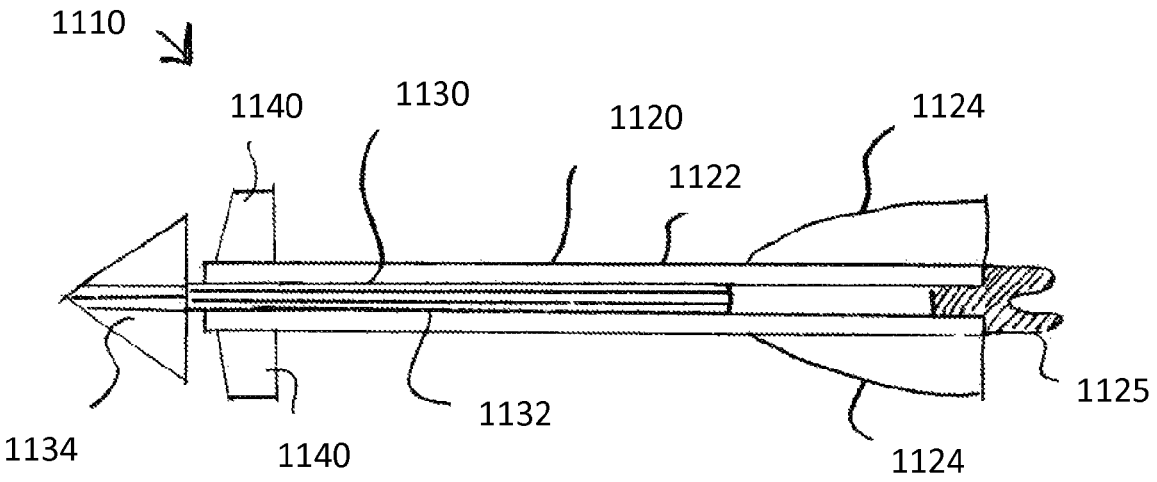
FIG. 17 illustrates in cross section a projectile including an outer shaft and an inner shaft, the outer shaft including a retention fins, in accordance with the present disclosure.

FIGS. 1-16B disclose an embodiment wherein a two-piece hunting projectile includes in outer shaft including a tip passing through the animal with an inner shaft being retained within the animal to facilitate bleeding. FIGS. 17-23 illustrate a related embodiment wherein a two-piece hunting projectile includes in inner shaft including a tip passing through the animal with an outer shaft being retained within the animal to facilitate bleeding. FIG. 17 illustrates in cross section a projectile including an outer shaft and an inner shaft. Projectile 1110 is illustrated, including tip outer shaft assembly 1120 and inner shaft assembly 1130. Outer shaft assembly 1120 includes outer shaft 1122, fletches 1124, optional nock 1125, and retention fins 1140. In the cross section of FIG. 17, only two fletches 1124 are illustrated. One having skill in the art will appreciate that it is common to have a plurality of fletches spaced at even radial locations around a shaft, for example, with three fletches located at 120 degree intervals around the shaft. Inner shaft assembly 1130 includes inner shaft 1132 and piercing tip 1124. Tip 1124 is illustrated as a broadhead tip known in the art, but any known hunting tip can be used according to the methods disclosed, and the disclosure is not intended to be limited to the particular exemplary embodiments provided herein. Tip 1124 is fastened to inner shaft 1132. In the embodiment of FIG. 17, tip 1124 includes threaded portion screwed into a mating inner diameter of inner shaft 1132, but a number of embodiments of methods to fasten tip 1124 to inner shaft 1132 can be utilized, and the disclosure is not intended to be limited to the particular exemplary embodiments provided herein.

Inner shaft 1130 includes an outer wall surface configured and sized to insert within an inner wall surface of outer shaft 1122. Inner shaft 1132 can slide within outer shaft 1122, such that retention fins 1140 are proximate to a tip 1124. Retention fins 1140 extend outwardly radially from the outer shaft and are configured to damage and/or grip to flesh of an animal as the outer shaft assembly enters and travels through the flesh of an animal. The retention fins are made of rigid material such that the fins can survive impact with the flesh of the hunted animal. The fins can be made of any rigid material, including but not limited to aluminum, spring steel or other steel, and a polymer. In one embodiment, the retention fins are swept backward on a front face to aid the fins penetrating deeply within the flesh. In one embodiment, the front fact of the fins can be sharpened to aid in the penetration. However, the fins should resist penetration more than the piercing tip to prevent the entire projectile from passing entirely through the hunted animal. In one embodiment, the front face of the retention fins can be a dull edge or a slightly flat face to moderate penetration. In one embodiment, the retention fins can be wider than the blades of a broadhead piercing tip, such that the edges of the fins that extend beyond the cuts made by the broadhead tip will slow down the outer shaft assembly.

The inner shaft assembly can include a minimum mass to facilitate the momentum of the inner shaft assembly causing the inner shaft assembly to carry through the animal further than the outer shaft assembly. A mass of the inner shaft can aid in adding to the mass of the inner shaft assembly. In one embodiment, inner shaft assembly 1130 can be substantially the length of the outer shaft 1122 such that the inner shaft assembly spans an entire cavity within outer shaft assembly 1120. In another embodiment, inner shaft assembly 30 can be some portion of the length of outer shaft assembly 1120. In one embodiment, the inner shaft assembly can be at least half the length of the outer shaft assembly. In another embodiment, the inner shaft can include a material or an insert therewithin to add mass to the inner shaft.

In one embodiment, inner shaft 1132 can have a substantially same outer diameter as an inner diameter of outer shaft 1122, such that the two shafts have a sliding contact. In another embodiment, the outer diameter of inner shaft 1130 can be smaller than the inner diameter of outer shaft 1120. In such an embodiment, fittings or o-rings can be used to center the inner shaft to the outer shaft to provide improved balance to projectile 1110 for accuracy. Nock 1125 may or may not be used, for example, with the nock being necessary for many arrow designs and the nock not being necessary for many bolt designs.

Normally a projectile can fly through a hunted animal, leaving only a narrow puncture wound which tends to close back up. Tip 1124 is designed to incise the flesh of the animal and pass through it as efficiently as possible. The narrow round shaft provides little resistance to passing through the flesh. Fletches 1124 are usually thin and aligned substantially with the shaft or slightly twisted around the shaft just enough to spin the projectile in flight. Such thin fletches are usually flexible and can easily pass through the flesh of the animal with the arrow. An apparatus is provided wherein projectile 1110 with outer shaft assembly 1120 can strike an animal with inner shaft assembly 1130 slidably inserted within outer shaft assembly 1120. The inner shaft assembly 1130 can pass directly through the animal. Outer shaft assembly 1120 is provided with retention fins 1140 configured not to pass easily through flesh, such that inner shaft assembly will not pass through the animal and remain inside the wound, stopping the wound from closing and providing for increased damage to the flesh as the retention fins 1140 become lodged in the animal. further, if the animal survives the initial impact and begins to run, the retention fins within the animal will gyrate with movement of the animal and cause additional tissue damage.

Figure 18:
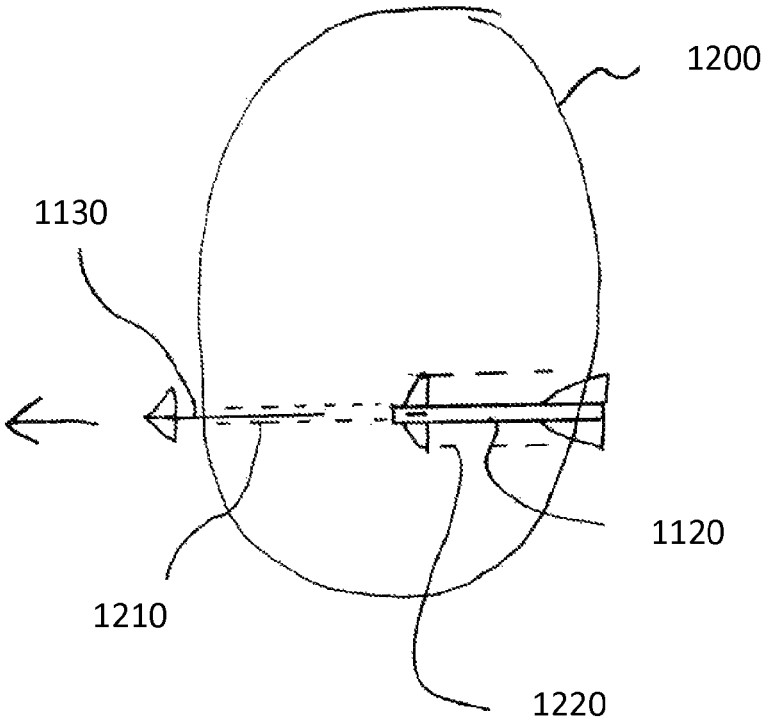
FIG. 18 illustrates an animal, an inner shaft assembly passing through the animal, and an outer shaft assembly remaining within the animal, in accordance with the present disclosure.

FIG. 18 illustrates an animal, an outer shaft assembly passing through the animal, and an inner shaft assembly remaining within the animal. Animal 1200 is illustrated, such as a torso in cross-section. A projectile including outer shaft assembly 1120 with inner shaft assembly 1130 inserted within outer shaft assembly 1120 has been shot at the animal. Inner shaft assembly 1130 is illustrated having passed through the animal and flying on past the animal. Inner shaft assembly 1130 including retention fins is shown impaled in the animal, with the outer shaft assembly having traveled with the inner shaft assembly until the retention fins cause the outer shaft assembly to stop within the animal. At that time, the inner shaft assembly continues on, while the outer shaft assembly stops forward motion and remains in the animal. A narrow damage path 1210 is illustrated caused by the tip of assembly 1130 passing through the animal, and a wide damage path 1220 is illustrated caused by the retention fins passing through the animal.

Figure 19:
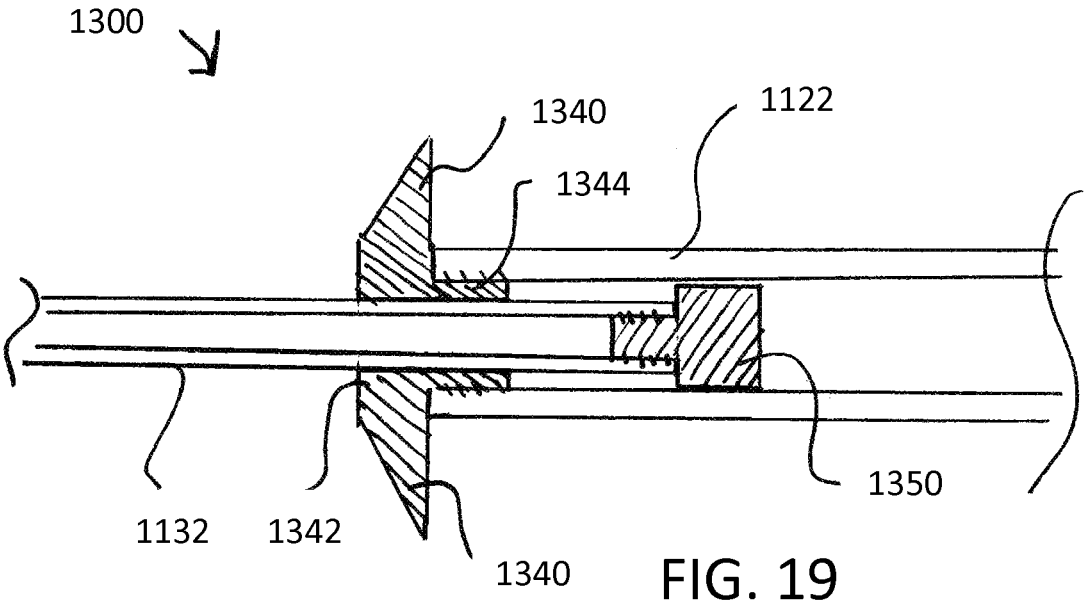
FIG. 19 illustrates an optional shaft coupling feature preventing separation of the two shafts, in accordance with the present disclosure.

In one embodiment, the inner shaft assembly is configured to be slide freely and exit entirely from the outer shaft assembly. In this way, the inner shaft assembly can carry through the hunted animal while leaving the outer shaft assembly behind as a wound resident member, facilitating bleeding and further tissue damage within the animal. FIG. 19 illustrates an optional embodiment wherein the inner shaft assembly and the outer shaft assembly include features preventing the inner shaft from fully exiting the outer shaft. Configuration 1300 includes an outer shaft 1122 and an inner shaft 1132. Inner shaft 1132 is substantially smaller in diameter than outer shaft 1122. Retention fin structure 1342 is affixed to a front opening of outer shaft 1122 and includes a plurality of retention fins 1340 and a threaded section 1344 for mating with a threaded section on an interior of outer shaft 1122. Retention fin structure 1342 includes a hole through which inner shaft assembly can slidingly travel back and forth. Stopper 1350 is attached to an inner diameter of inner shaft 1132. A diameter of a wide section of stopper 1350 is sized to be similar but slightly smaller than an inner diameter of outer shaft 1122, permitting inner shaft 1132 to freely slide in and out of outer shaft 1122. Stopper 1350 is sized to not be able to pass through the hole in retention fin structure 1342. In such an embodiment, the projectile can be fired with inner shaft 1132 fully inserted within outer shaft 1122. As the projectile enters the animal, increased drag on retention fins 1340 causes the inner shaft 1132 to be extended out of the outer shaft 1122. As the stopper 1350 contacts structure 1342, the inner shaft and the outer shaft are fully extended, therefore, including a long projectile retained within the animal, possibly with ends of the shafts sticking out of either side of the animal, maximizing damage to the animal.

Figure 20:
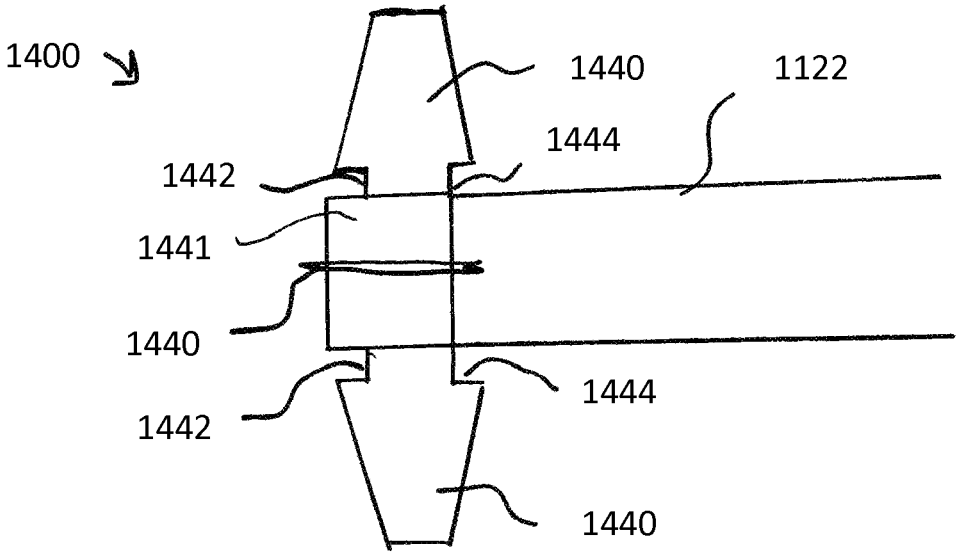
FIG. 20 illustrates retention fins including gripping features, in accordance with the present disclosure.

FIG. 20 illustrates exemplary retention fins including gripping features. Configuration 1400 includes outer shaft 1122 connected to a retention fin structure 1441. Structure 1441 includes a plurality of retention fins 1440, with each fin including gripping features 1442 located on a front side of the fins and gripping features 1444 located on a rear side of the fins. As the fins pass through the flesh of the animal, retention features 1442 catch on flesh and distort the flesh of the animal, maximizing damage to the flesh. Further, should a front portion of the projectile pass out of the animal, if the animal attempts to pull the projectile out, features 1442 will resist and/or maximize damage in response to the pulling. Similarly, features 1444 are configured to resist and/or maximize damage in response to the animal attempting to pull the projectile backwards from the wound. Either features 1442 or features 1444 can be included or excluded entirely or from individual fins, for example, enabling fine tuning of how far the retention fins pass through the animal.

Any number of fins can be used. Fins can be aligned to the longitudinal axis of the outer shaft. In the alternative, the fins can be angled slightly to cause the outer shaft to spin through the flesh of the animal, maximizing damage to the flesh. Fin width, height, and profile can be modulated based upon desired action of the projectile within the animal. For example, particular features can be optimized for smaller game such as turkey, other features can be optimized for medium game, such as white-tailed deer, and other features can be optimized for large game such as moose or bear.

Further, features can be optimized based upon the firing energy of the bow or crossbow utilized.

Figure 21:
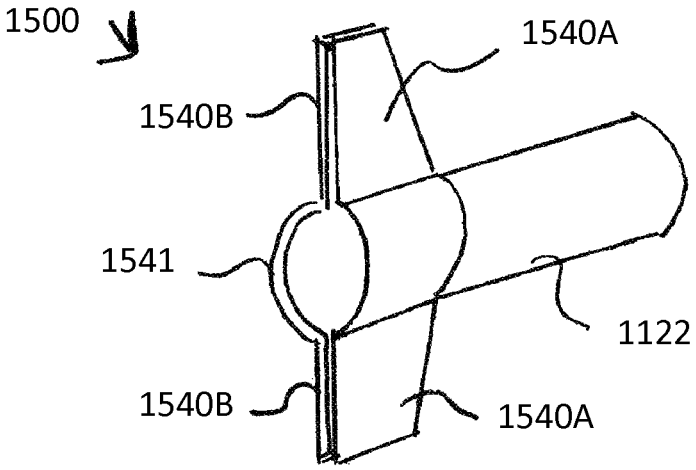
FIG. 21 illustrates exemplary retention fins including two matching pieces of spring steel, in accordance with the present disclosure.

A projectile is preferably aerodynamic for stable and accurate flight. Based upon high energy devices such as modern crossbows, an excess of energy can be imparted to the projectile, making it possible for certain configurations of retention fins to pass entirely through the animal, thereby wasting the energy associated with the outer shaft assembly passing through the animal. FIG. 21 illustrates exemplary pairs of opposing retention fins constructed of spring steel in an initial shape, such that the opposing fins are flat and closely aligned to the longitudinal axis of the shaft. Configuration 1500 includes outer shaft 1122 and retention fin structure 1541. Structure 1541 includes fins 1540A on one side of the structure and fins 1540B on a second side of the structure. Fins 1540A and 1540B can be connected at their base close to the shaft 1122 or connected to a common ring. Fins 1540A and 1540B can be separate but parallel toward the ends of the fins.

Figure 22:
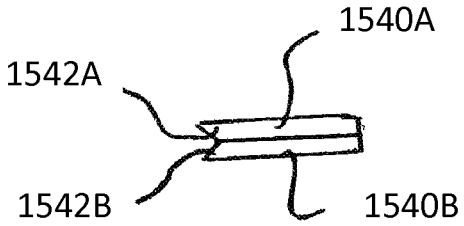
FIG. 22 illustrates a top view of the retention fins of FIG. 21, in accordance with the present disclosure.

FIG. 22 illustrates a top view of the retention fins of FIG. 21. Fins 1540A and 1540B are illustrated, for example, viewing the fins from an outward radial direction of the shaft 1122 of FIG. 21 to an inward radial direction of shaft 1122. Exemplary knife edge features 1542A and 1542B are illustrated on respective front edges of fins 1540A and 1540B. Features 1542A and 1542B can be configured to cause a spreading motion of fins 1540A and 1540B as the fins pass through the flesh of the animal. The spring steel of the fins can be selected in order to create reasonable stable fins in flight while maximizing spreading of the fins within the flesh of the animal.

Figure 23:
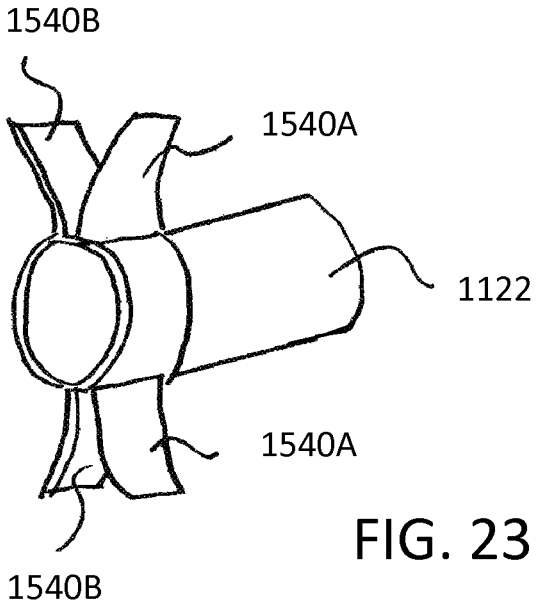
FIG. 23 illustrates the retention fins of FIG. 21 spread apart after being fired into an animal, in accordance with the present disclosure.

FIG. 23 illustrates the retention fins of FIG. 21 after the fins have been fired at an animal. The spreading of fins 1540A and 1540B has resulted in the fins being bent outward from each other. It will be appreciated that the fins being bent outward would create increased damage in the flesh as the spread fins pass through the flesh of the animal.

The inner shaft can be solid or hollow. A number of different materials can be used on the inner shaft, including aluminum, brass, or polymers, and a number of materials can be used on the retention fins, including aluminum, spring steel, or polymers. The retention fins can be located at the front of the outer shaft assembly and/or further back along the outer shaft.

The disclosure has described certain preferred embodiments and modifications of those embodiments. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. Apparatus to maximize damage from a projectile to a hunted animal, the apparatus comprising:
- a hunting projectile comprising:
  - an outer shaft assembly comprising an outer shaft, fletches, and a plurality of retention fins extending outwardly radially from the outer shaft; and
  - an inner shaft assembly fitting slidably inside the outer shaft and comprising an inner shaft and a piercing tip;
- wherein the outer shaft assembly further comprises retention fins extending outwardly radially from the outer shaft; and
- wherein the retention fins are swept back on a front face.

2. Apparatus to maximize damage from a projectile to a hunted animal, the apparatus comprising:
- a hunting projectile comprising:
  - an outer shaft assembly comprising an outer shaft, fletches, and a plurality of retention fins extending outwardly radially from the outer shaft; and
  - an inner shaft assembly fitting slidably inside the outer shaft and comprising an inner shaft and a piercing tip;
- wherein the outer shaft assembly further comprises retention fins extending outwardly radially from the outer shaft; and
- wherein the retention fins are sharpened on a front face.

3. Apparatus to maximize damage from a projectile to a hunted animal, the apparatus comprising:
- a hunting projectile comprising:
  - an outer shaft assembly comprising an outer shaft, fletches, and a plurality of retention fins extending outwardly radially from the outer shaft; and
  - an inner shaft assembly fitting slidably inside the outer shaft and comprising an inner shaft and a piercing tip;
- wherein the outer shaft assembly further comprises retention fins extending outwardly radially from the outer shaft; and
- wherein the retention fins extend further outwardly radially than a broadhead tip of the piecing tip extends outwardly radially.

4. Apparatus to maximize damage from a projectile to a hunted animal, the apparatus comprising:
- a hunting projectile comprising:
  - an outer shaft assembly comprising an outer shaft, fletches, and a plurality of retention fins extending outwardly radially from the outer shaft; and
  - an inner shaft assembly fitting slidably inside the outer shaft and comprising an inner shaft and a piercing tip;
- wherein the outer shaft assembly further comprises retention fins extending outwardly radially from the outer shaft; and
- wherein one of the retention fins includes a gripping feature located on a front side of the fin.

5. Apparatus to maximize damage from a projectile to a hunted animal, the apparatus comprising:
- a hunting projectile comprising:
  - an outer shaft assembly comprising an outer shaft, fletches, and a plurality of retention fins extending outwardly radially from the outer shaft; and
  - an inner shaft assembly fitting slidably inside the outer shaft and comprising an inner shaft and a piercing tip;
- wherein the outer shaft assembly further comprises retention fins extending outwardly radially from the outer shaft; and
- wherein one of the retention fins includes a gripping feature located on a rear side of the fin.

6. The apparatus of claim 5, wherein each of the retention fins includes a first gripping feature located on a front side of the fin and a second gripping feature located on a rear side of the fin.

7. Apparatus to maximize damage from a projectile to a hunted animal, the apparatus comprising:
- a hunting projectile comprising:
  - an outer shaft assembly comprising an outer shaft, fletches, and a plurality of retention fins extending outwardly radially from the outer shaft; and
  - an inner shaft assembly fitting slidably inside the outer shaft and comprising an inner shaft and a piercing tip;
- wherein the outer shaft assembly further comprises pairs of opposing retention fins extending outwardly radially from the outer shaft, wherein the opposing retention fins are configured to deform away from each other upon entering the hunted animal.

* * * * *